US007028631B2

(12) United States Patent
August

(10) Patent No.: US 7,028,631 B2
(45) Date of Patent: Apr. 18, 2006

(54) GLIDING SUBMERSIBLE TRANSPORT SYSTEM

(75) Inventor: Henry August, Chatsworth, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/720,937

(22) Filed: Nov. 24, 2003

(65) Prior Publication Data

US 2005/0109259 A1 May 26, 2005

(51) Int. Cl.
*B63B 3/13* (2006.01)

(52) U.S. Cl. ..... 114/312; 114/245; 114/345

(58) Field of Classification Search ..... 114/243, 114/244, 245, 312, 315, 332, 345
See application file for complete search history.

(56) References Cited

U.S. PATENT DOCUMENTS 2,377,442 A * 6/1945 Osterhoudt ..... 114/245
3,160,133 A * 12/1964 Walker ..... 114/245
4,463,701 A * 8/1984 Pickett et al. ..... 114/245
5,402,745 A * 4/1995 Wood ..... 114/244
5,522,337 A * 6/1996 Meyers et al. ..... 114/312
6,328,622 B1 * 12/2001 Geery ..... 114/332
6,655,313 B1 * 12/2003 Woodall et al. ..... 114/312

* cited by examiner

*Primary Examiner*—Lars A. Olson
(74) *Attorney, Agent, or Firm*—Robert R. Richardson, P.S.

(57) ABSTRACT

Embodiments of the present invention provide a gliding submersible transport system. Exemplary submersible gliders have wings capable of providing sufficiently high lift-to-drag ratios such that the submersible gliders of may be used for transporting large volumes of military or commercial hardware, equipment, personnel, or the like. According to one exemplary embodiment of the present invention, a submersible glider has a step-wise glider range. The glider includes a substantially cylindrical hull having a bow and a stern. A generally planar lifting surface is disposed toward the stern. The lifting surface has a pair of generally planar stabilizer surfaces that extend generally perpendicular to a plane of the lifting surface from ends of the lifting surface. A nose cone and at least one steering device are disposed toward the bow.

60 Claims, 20 Drawing Sheets

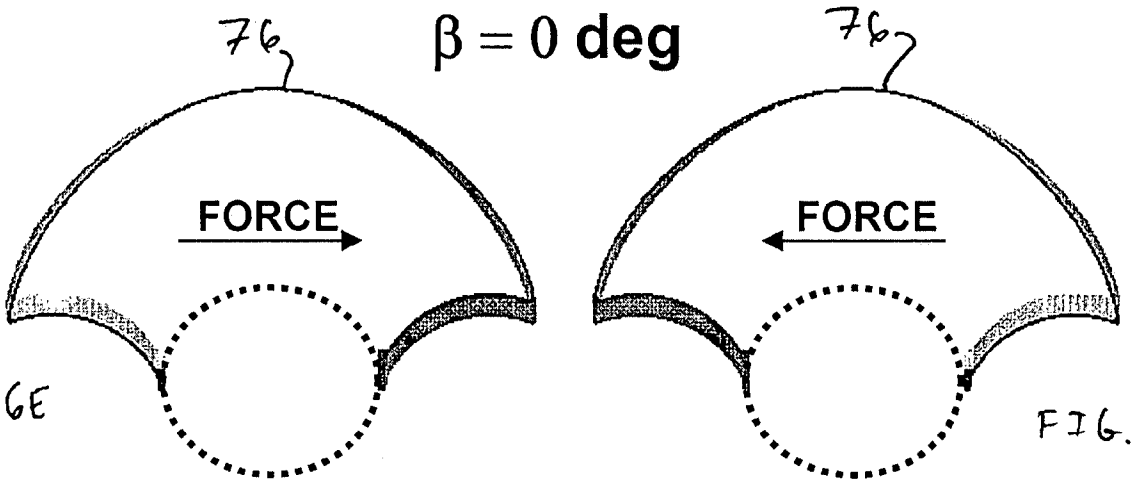
FIG. 6E
FIG. 6F
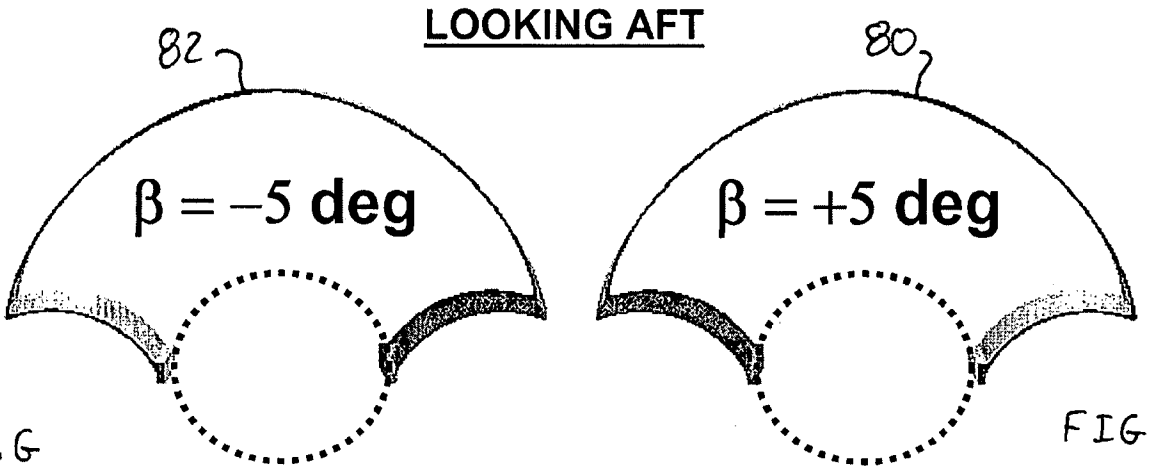
FIG. 6G
FIG. 6H

92

$C_L$ vs Alpha at Mach 0.15 (lift enhancement).

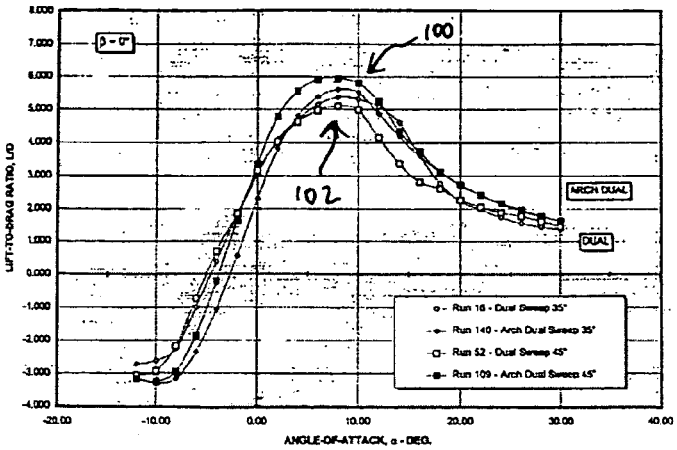
Figure 12. $L/D_{max}$ vs Alpha at Mach 0.15 (increased glide range).
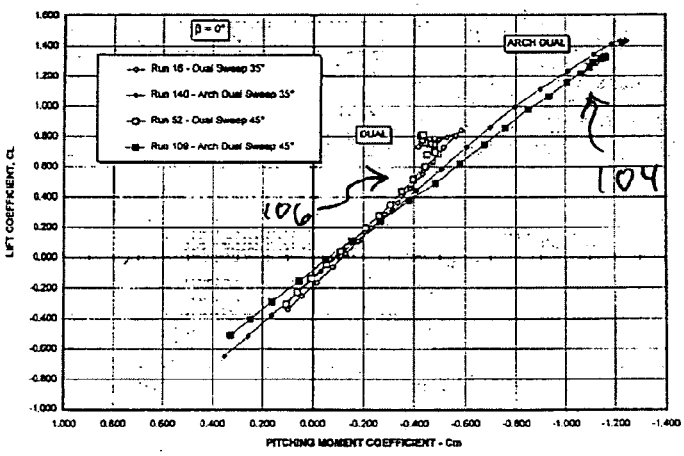
Figure 13 $C_L$ vs $C_m$ at Mach 0.15 (higher stability in pitch).
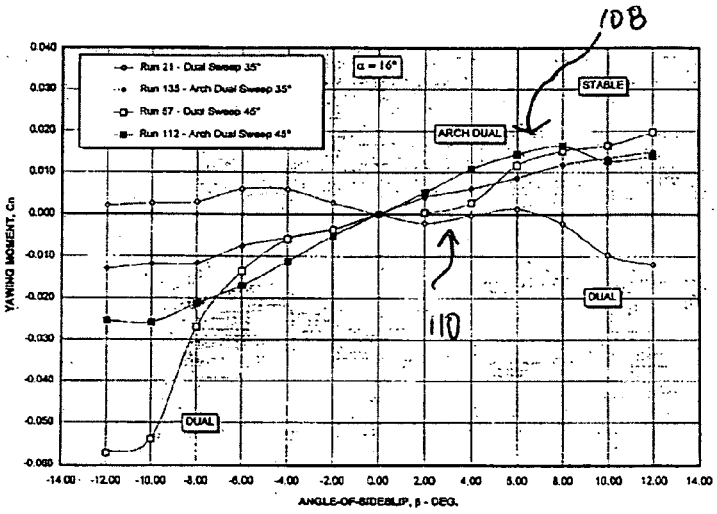
Figure 14. $C_n$ vs β at Mach 0.15 (higher stability in sideslip).

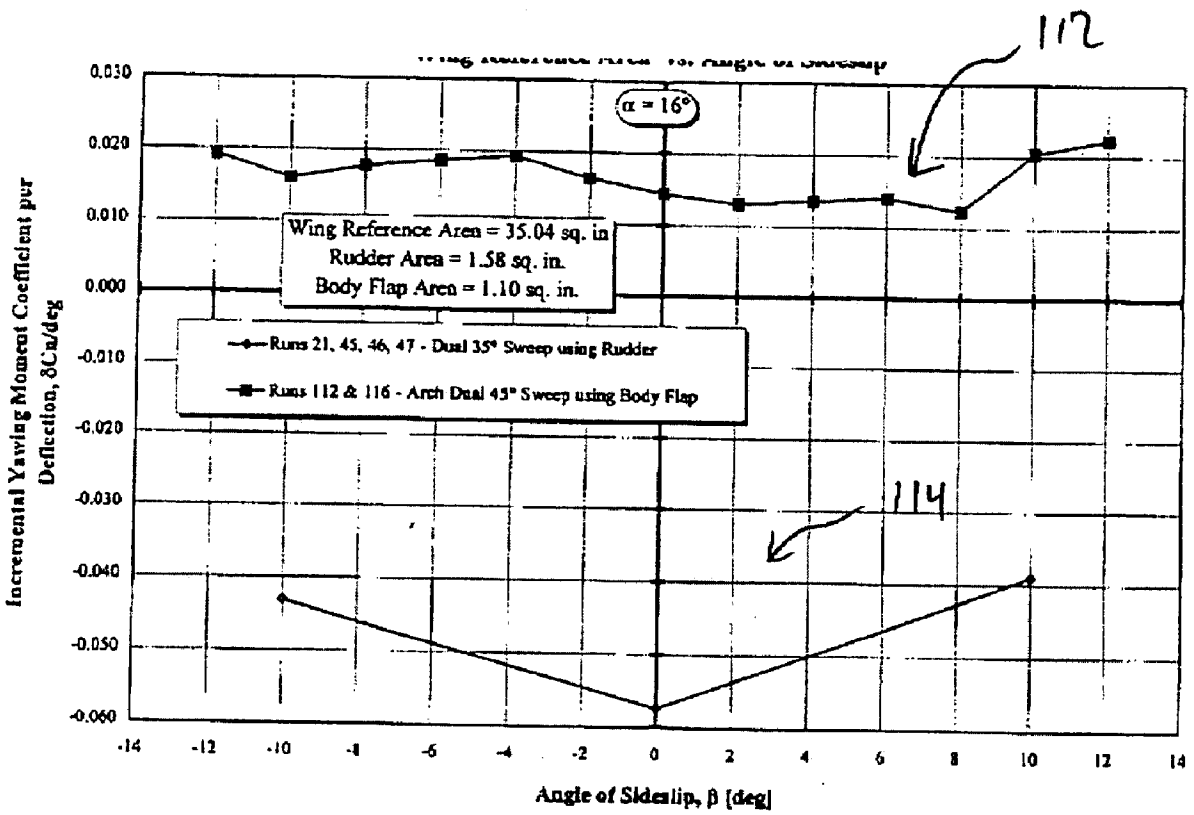
Figure 15 Incremental yawing moment coefficient per deflection vs angle of slideslip demonstrating yawing moment control.

5

GLIDING SUBMERSIBLE TRANSPORT SYSTEM

FIELD OF THE INVENTION

The present invention relates generally to submersible vehicles and, more specifically, to submersible gliders.

BACKGROUND OF THE INVENTION

Marine vessels have long been used for commercial and military purposes. For example, commercial ships transport goods and tourists. As another example, military surface ships project power and deliver ordnance to targets, deliver military supplies and logistics, and transport military personnel. Further, military submarines deliver ordnance to targets and provide strategic deterrence from stealthy platforms. Finally, civilian and military marine vessels engage in scientific research of the ocean environment.

In some applications, it would be desirable to accomplish some of the objectives listed above through use of unmanned marine vessels. For example, use of an unmanned marine vessel to deliver ordnance, such as a torpedo, to a target would permit the ordnance to be delivered to the target without putting sailors in harm's way. However, currently known unmanned delivery vehicles produce large amounts of noise. As a result, currently known delivery vehicles may not bring significant amounts of stealth to a tactical situation. Thus, a target may gain a tactical advantage. Accordingly, effectiveness of currently known delivery vehicles may be diminished.

In order to maximize Mission effectiveness of unmanned marine vessels, it would be desirable to increase the amount of stealth enjoyed by the unmanned marine vehicle. Currently known submersible gliders, such as the Seaglider, can be considered stealthy submersible vehicles. The submersible gliders have high aspect ratio wings that impart a forward gliding to the glider as the glider experiences changes in ballast and their resultant changes in buoyancy.

Currently known underwater gliders can propel themselves for an extended period of time by modulating buoyancy through controlled ballasting. That is, gliders trade potential energy into work against drag. An underwater glider that is designed to be nearly-neutrally buoyant at the surface sinks very slowly. Therefore, the glider can attain extended range via its high lift-to-drag ratio that is largely achieved by its lifting surface. Once the glider attains its desired depth, internal air volume of the glider is increased, thereby lowering its density. This increases buoyancy force above weight of the glider, and the glider buoys upward to the surface of the sea. This phenomenon of using buoyancy to energize an underwater glider functions until ballasts are exhausted. That is, underwater gliding refers to motion in which the force of gravity provides propulsion, while steering is maintained typically by controlling location of the center of gravity of the vehicle.

Many currently known underwater gliders are used for oceanographic research, meteorology research, and deep-sea surveying. These currently known gliders used fixed wings for glide and pitch control and internal ballasts for depth and altitude control. For example, the "Slocum" glider uses ballast tanks to provide pitching moment's joint upward and downward glides and a sliding battery mass for fine adjustment of pitch and roll. With an operational range of 40,000 km, Slocum obtained its propulsive energy from thermal gradients in the water using a thermal engine that draws energy from ocean thermal clients (that is, temperature differences between warm surface water and cooler, deep water). Another currently known glider, "Spray," has a range of 6000 km and has been developed and demonstrated under similar gliding principles to the Slocum. Apart from saving energy for propulsion, Spray lasts longer and operates more quietly than Slocum because of a lack of moving surfaces.

However, currently known gliders have limited glider range and applicability. For example, the Seaglider can attain speeds up to 0.5 knots at glide angles from 8° to 70° (1:5–3:1 slope). Because of the Seaglider's limited speed and glide capabilities, the Seaglider is limited to oceanographic research.

It would be desirable for an unmanned marine vehicle to provide for delivery of ordnance, supplies, personnel, or the like. However, internal capacities of currently known gliders are limited due to extensive components for ballasting and steering. Therefore, there is an unmet need in the art for an unmanned submersible transport system that provides desired stealth, speed, and other performance characteristics.

SUMMARY OF THE INVENTION

Embodiments of the present invention provide a gliding submersible transport system. Exemplary embodiments provide submersible gliders having wings capable of providing sufficiently high lift-to-drag ratios such that the submersible gliders of the present invention may be used for transporting large volumes of military or commercial hardware, equipment, personnel, or the like.

According to one exemplary embodiment of the present invention, a submersible glider has a step-wise glider range. The glider includes a substantially cylindrical hull having a bow and a stern. A generally planar lifting surface is disposed toward the stern. The lifting surface has a pair of generally planar stabilizer surfaces that extend generally perpendicular to a plane of the lifting surface from ends of the lifting surface. A nose cone and at least one steering device are disposed toward the bow.

According to an aspect of this embodiment of the present invention, the lifting surface is an "arch wing" with a box plane-like design that provides a higher effective aspect ratio than a planar wing with a comparable planform. As a result, higher lift and greater hydrodynamic efficiency (that is, to lift-to-drag ratio) are generated than in a corresponding planar wing. Extended stepwise glide ranges result from use of the arch-wing. The submersible glider gradually buoys to the surface under controlled ballasting and repeatedly glides forward along a glide path slope determined by the lift-to-drag ratio. Advantageously, the submersible glider of this embodiment of the present invention may slowly and quietly transport heavy payloads including special supplies, sensor platforms, ordnance, and heavy equipment as desired, such as an unmanned aerial vehicle (UAV).

According to another embodiment of the present invention, a marine transport system is provided. The transport system includes a submersible glider having a step-wise glider range, such as described above. A surfaced glider has a towing mechanism configured to reel in and reel out from the surfaced glider a tow line that is connectable to the submersible glider.

According to an aspect of this embodiment of the present invention, a surfaced glider defines a hold that may be configured as a personnel cabin for surfaced transport of personnel. Advantageously, the personnel are housed in the surfaced glider that is designed to float and travel along the sea surface. The surfaced glider may be "self-towed" forward to the submersible glider after the submersible glider buoys to the surface. As a result, personnel may be transported in a relatively safe and stealthy manner. Use of the surfaced glider to transport personnel avoids risks and extreme costs incurred with transport of personnel in a submerged glider. Advantageously, use of the surfaced glider avoids complex underwater life-support and emergency escape systems for submerged transport of personnel.

BRIEF DESCRIPTION OF THE DRAWINGS

The preferred and alternative embodiments of the present invention are described in detail below with reference to the following drawings.

FIGS. 6A–6H illustrate details of control surfaces of the glider of FIG. 1;

FIG. 12 is a graph of lift-to-drag ratio versus angle of attack for the glider of FIG. 1;

FIG. 13 is a graph of lift coefficient versus pitching moment coefficient for the glider of FIG. 1;

FIG. 14 is a graph of yawing moment versus angle of sideslip for the glider of FIG. 1;

FIG. 15 is a graph of incremental yawing moment coefficient per deflection versus angle of sideslip for the glider of FIG. 1;

DETAILED DESCRIPTION OF THE INVENTION

By way of overview, embodiments of the present invention provide a gliding submersible transport system. Exemplary embodiments provide submersible gliders having wings capable of providing sufficiently high lift-to-drag ratios such that the submersible gliders of the present invention may be used for transporting large volumes of military or commercial hardware, equipment, personnel, or the like. According to one exemplary embodiment of the present invention, a submersible glider has a step-wise glider range. The glider includes a substantially cylindrical hull having a bow and a stern. A generally planar lifting surface is disposed toward the stern. The lifting surface has a pair of generally planar stabilizer surfaces that extend generally perpendicular to a plane of the lifting surface from ends of the lifting surface. A nose cone and at least one steering device are disposed toward the bow. According to another embodiment of the present invention, a marine transport system is provided. The transport system includes a submersible glider having a step-wise glider range, such as described above. A surfaced glider has a towing mechanism configured to reel in and reel out from the surfaced glider a tow line that is connectable to the submersible glider.

Exemplary embodiments of submersible and surfaced gliders will be briefly introduced, followed by details of their construction and operation. In addition, exemplary scenarios of missions that may be performed by embodiments of the present invention will be explained.

Figure 1:
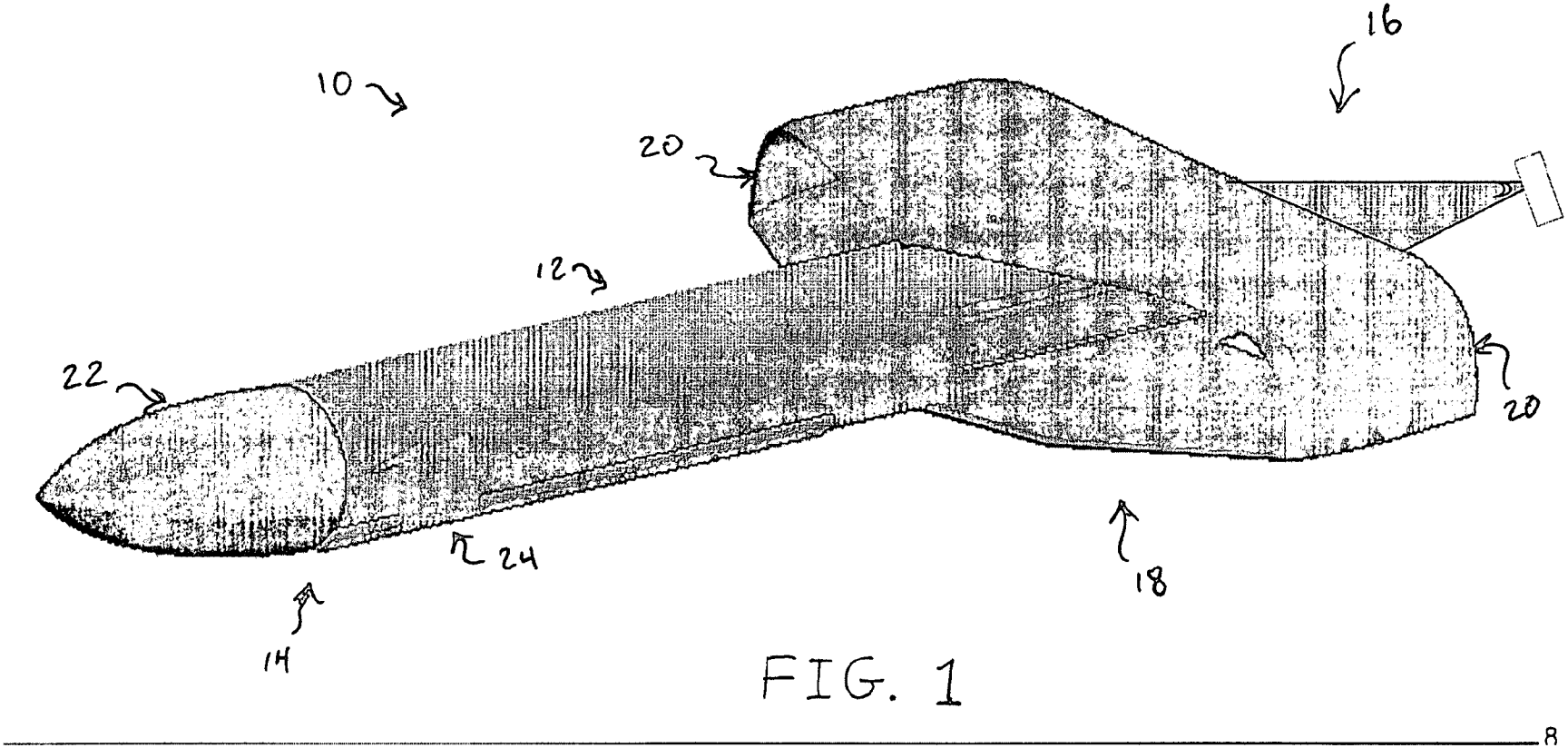
FIG. 1 is a perspective view of a submersible glider according to an embodiment of the present invention.

Referring briefly to FIG. 1 and given by way of nonlimiting example, a submersible glider 10 according to one exemplary embodiment of the present invention has a step-wise glider range (described below with reference to FIG. 10). The glider 10 includes a substantially cylindrical hull 12 having a bow 14 and a stern 16. A generally planar lifting surface 18 is disposed toward the stern 16. The lifting surface 18 has a pair of generally planar stabilizer surfaces 20 that extend generally perpendicular to a plane of the lifting surface 18 from ends of the lifting surface 18. A nose cone 22 and at least one steering device 24 are disposed toward the bow 14.

Figure 2:
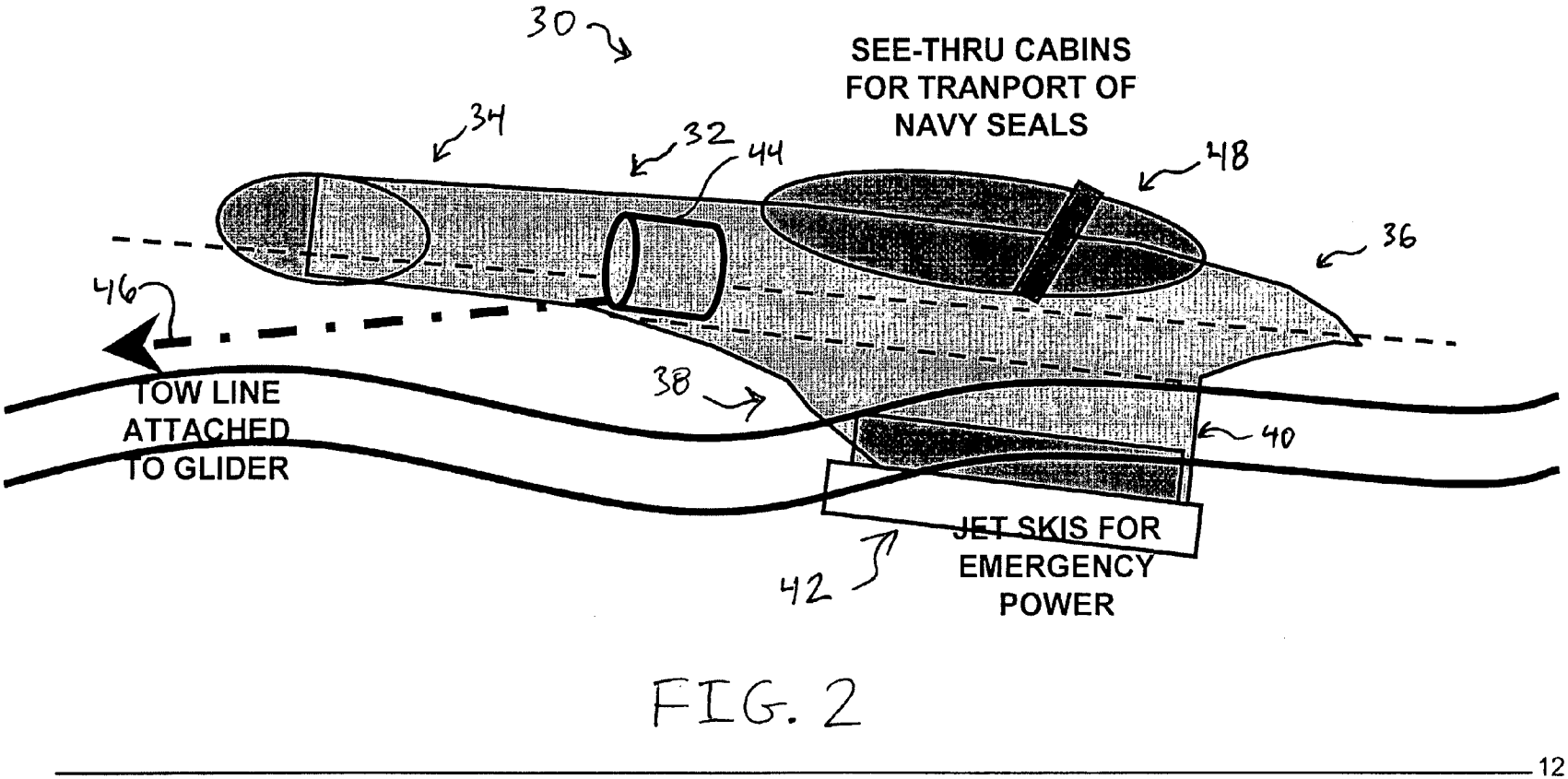
FIG. 2 is a side plan view of a glider according to another embodiment of the present invention.

Referring briefly now to FIG. 2 and given by way of nonlimiting example, a surfaced and submersible glider 30 according to another exemplary embodiment of the present invention includes a wave-piercing hull 32 having a bow 34 and a stern 36. A generally planar surface 38 is substantially disposed toward the stern 36. The generally planar surface 38 has a pair of generally planar stabilizer surfaces 40 that extend generally perpendicular to a plane of the generally planar surface 38 from ends of the generally planar surface 18. A pair of lifting skis 42 suitably may be disposed on the pair of stabilizer surfaces 40 for emergency power. A towing mechanism 44 is mounted to the hull 32 and is configured to reel in and reel out to and from the glider 30 a tow line 46. A hold 48 may be configured as a personnel cabin for surfaced transport of personnel.

Figure 3:
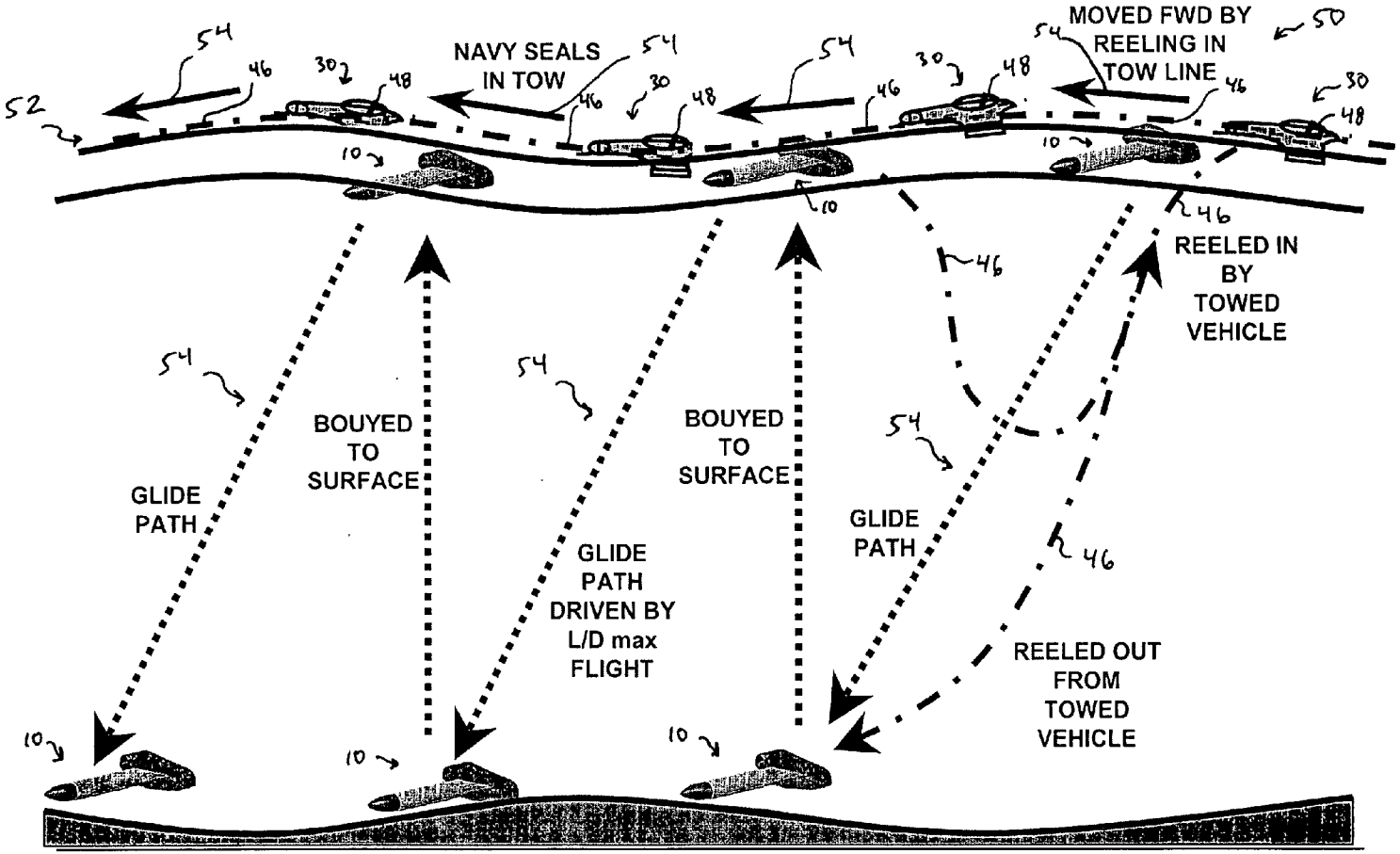
FIG. 3 illustrates an exemplary marine transport system incorporating the gliders of FIGS. 1 and 2.

Referring now to FIG. 3, a marine transport system 50 includes the submersible glider 10 and the surfaced glider 30. The tow line 46 is connected to the submersible glider 10. Advantageously, personnel are housed in the cabin 48 of the surfaced glider 30 that is designed to float and travel along a surface 52 of the sea. The surfaced glider 30 is "self-towed" forward to the submersible glider 10 after the submersible glider 10 buoys to the surface. Specifically, as the submerged glider 10 descends from the surface 52, the glider 10 travels forward along a glide path 54. During descent of the glider 10, the tow line 46 is reeled out from the surfaced glider 30 by the towing mechanism (FIG. 2). This reeling out of the tow line prevents the surfaced glider 30 from being pulled under the surface 52 by the glider 10 as the glider 10 descends. While the glider 10 buoys to the surface 52 under controlled ballasting, or alternately after the glider 10 has surfaced, the towing mechanism 44 (FIG. 2) reels in the tow line 46. This reeling in of the tow line 46 imparts a forward motion indicated by an arrow 54. The descent, reeling out, ascent, reeling in, and forward motion cycle is repeated as desired for a particular scenario, mission, application, or the like. As a result, personnel may be transported in a relatively safe, stealthy, and low cost manner. It will be appreciated that use of the surfaced glider 30 to transport personnel avoids risks and extreme costs incurred with transport of personnel in a submerged glider. Advantageously, use of the surfaced glider 30 avoids complex underwater life-support and emergency escape systems for submerged transport of personnel. In addition, this dual vehicle approach maximizes the use of internal volume of the submerged glider 10 for the transport of equipment and goods.

Now that embodiments of the submerged glider 10 and the surfaced glider 30 and an embodiment of the marine transport system 50 that incorporates the gliders 10 and 30 have been briefly introduced, details of their construction, operation, and use will now be explained.

Referring now to FIGS. 4A–4E, to the glider 10 advantageously incorporates an "arch wing" design for the lifting surface 18. The arch wing has a boxplane-like design including end plates, which are the stabilizer surfaces 20 that provide a higher effective aspect ratio than a planar wing with a comparable planform. In addition to the outboard stabilizer surfaces 20, the lifting surface 18 includes an upper wing panel 60 and a lower wing panel 62. The upper and lower wing panels 60 and 62 are highly swept. The stabilizer surfaces 20 extend substantially normally, that is substantially perpendicularly, between the upper and lower wing panels 60 and 62. In one exemplary embodiment, hydrodynamic control surfaces such as elevons 64 are provided at a trailing edge 66 of the lower wing panel 62.

Advantageously, the arch wing design of the lifting surface 18 imparts to the glider 10 an efficient glide ratio, that is horizontal distance traversed over vertical distance descended in a given time interval. As a result, the glider 10 achieves a useful combination of glider range and diving depth. That is, the glider 10 yields high hydrodynamically lift-to-drag ratios so as to maximize its step-wise glide range. The lifting surface 18 yields high lift-to-drag with minimum noise disturbances in the fluid flow. As a result, the high-aspect ratio planar wings of the lifting surface 18 yield extended glide slopes, longer glide ranges, stability in pitch, yaw, and roll, and greater maneuverability for maintaining desired flight directions and pathways against countering sea currents. In addition, the arch wing design of the lifting surface 18 provides a stronger structural truss in lift than does a planar wing of conventional planform.

The arch wing design of the lifting surface 18 yields a favorable hydrodynamic "end-plate wing" effects. These effects induce a higher effective aspect ratio then either of the upper or lower wing panels 60 and 62. As result, wing tip losses are reduced. Correspondingly, the drag-due-to-lift of the arch wing is reduced and hydrodynamic efficiency (that is, lift-to-drag ratio) is increased. Because the highly swept lifting surface 18 is located aft, that is toward the stern 16, the stabilizer surfaces 20 act as pseudo-twin vertical stabilizers. Further, the lifting surface 18 enjoys added lift and greater stability by a captured "bent streamtube" process, which at incidence, reacts to downward turning of the captured streamtube. This contribution to lift is similar to that provided by the inlet of a jet power aircraft at incidence.

Advantageously, the elevons 64 provide control surfaces for pitch and roll. Consequently, the glider 10 need not employ a conventional traversing inner weight device for varying location of center of gravity of the glider 10. Use of the elevons 64 instead of conventional traversing inner weight devices provides a significant advantage of preserving inner volume of the glider 10 such that transportation of equipment and payloads can be maximized.

High strength airbags (not shown) are positioned externally on sides of the hull 12 and within outer regions between the upper and lower wing panels 60 and 62. The airbags may be made of a high-strength, light-weight material such as Mylar®. To preserve internal volume of the hull 12 for the transporting of equipment, on-board ballasting is done by gaseous inflation, such as by an inert gas like nitrogen, of the externally mounted airbags. The glider 10 is nearly-neutrally buoyant at the surface and can slowly and stealthily sink along a shallow glide path, thereby achieving extended ranges via a high lift-to-drag ratio. Upon the glider 10 reaching desired depth, the airbags are inflated using the on-board ballasts. This lowers overall density of the glider 10 and largely increases buoyancy of the glider 10, thereby driving the glider 10 toward the surface of the sea. This approach of external ballasting also accommodates extra heavy payloads by use of more airbags, larger airbags, or both more and larger airbags.

Figure 4C:
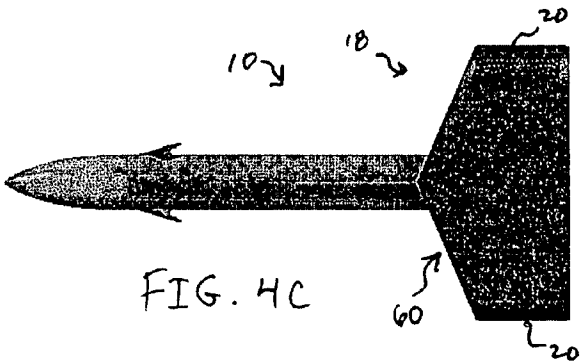
FIGS. 4A–4E illustrate details of a wing of the glider of FIG. 1.
Figure 4D:
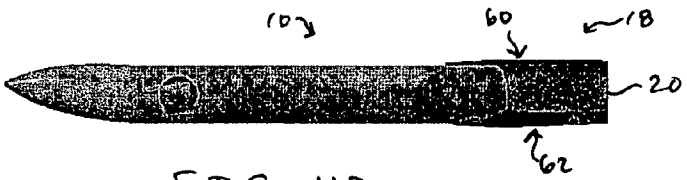
Figure 4E:
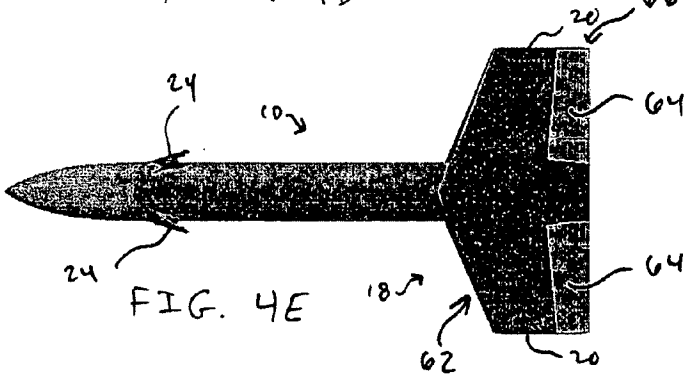
Figure 4A:
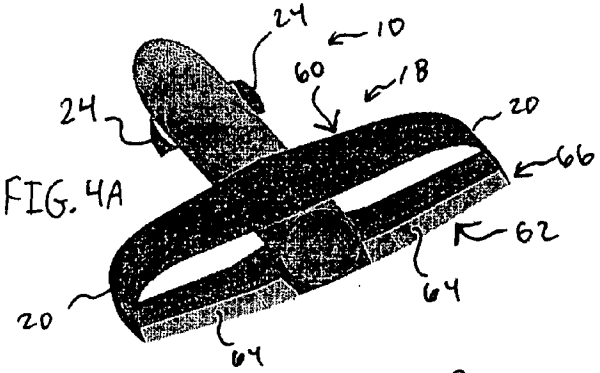
Figure 4B:
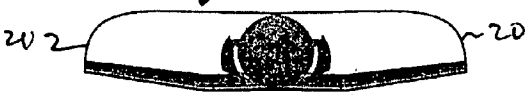

Referring now to FIGS. 1, 4B, and 4E, the steering devices 24 are forward-mounted, lateral control surfaces. The steering device is 24 are side-mounted, low-drag conformal steering devices that are deflected outboard (left or right hand). Advantageously and in addition, the steering devices 24 can be used with symmetric deflections as aids for achieving trim in pitch (producing nose-up moment contributions as needed).

Figure 5B:
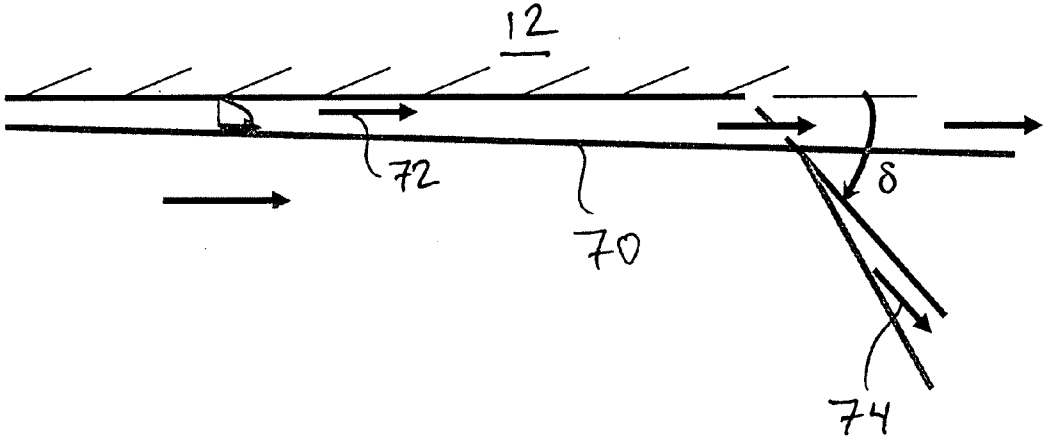
FIGS. 5A and 5B illustrate details of a steering device of the glider of FIG. 1.
Figure 5A:
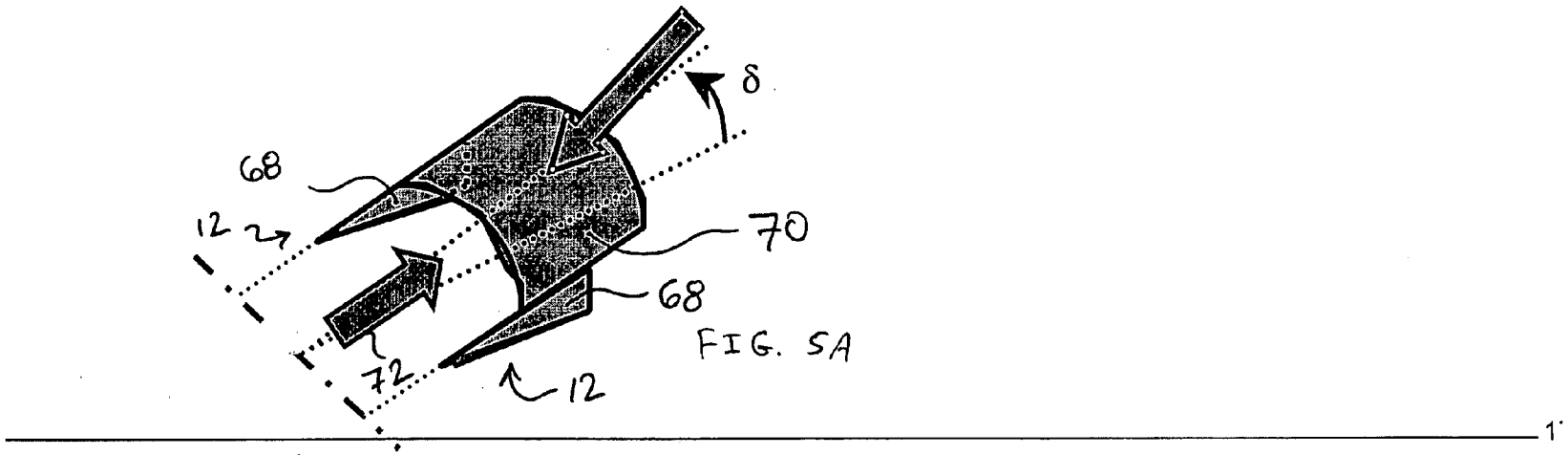

Referring now to FIGS. 5A and 5B, the steering devices 24 increase control effectiveness and reduce heat load. Outboard, stilt-like panels 68 are mounted to and rotate trailing edge outward from the hull 12. A deflection surface 70 is mounted to the panels 68 such that the leading edge of the deflected surface 70 is spaced apart from the hull 12. As a result, a boundary layer of fluid, indicated by an arrow and 72, flows between the deflection surface 70 and the hull 12. That is, the panels 68 provide a kept, stand-off region that allows boundary layer flow to propagate therethrough. As the boundary layer flow propagates through the panels 68 and above and under an outer deflection surface 71 as indicated by the arrow 72, a hydrodynamic lateral force, indicated by an arrow 74, is generated at the forward region of the glider's hull 12. A steering deflection angle $\delta$ results. Actuators (not shown) for rotation of the stilt-like panels 68 and deflection surface 70 suitably are housed within the glider's hull 12 just forward of the steering devices 24. The actuators may be any suitable electromechanically driven devices.

Figures 6A, 6B, 6C:
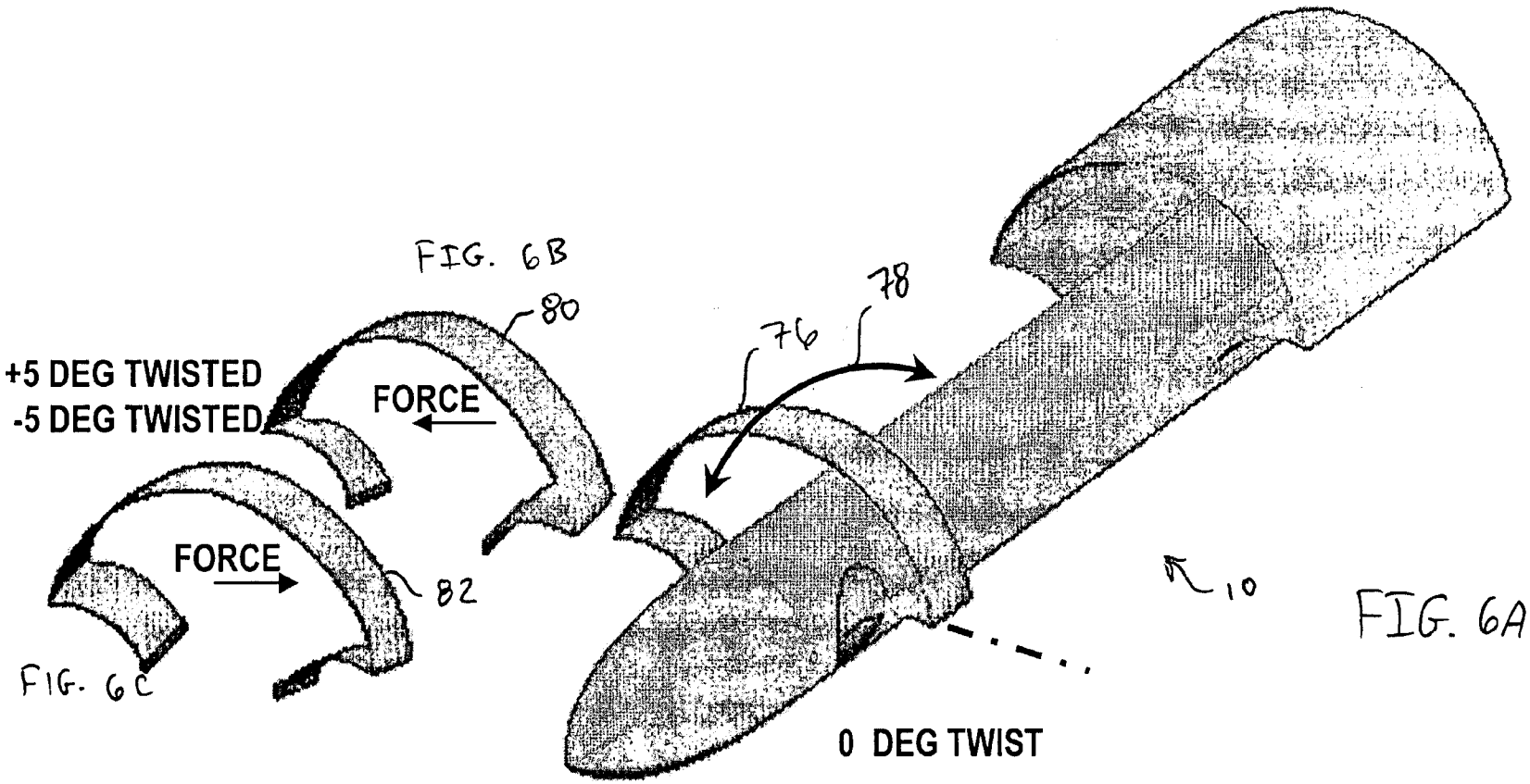
Figure 6D:
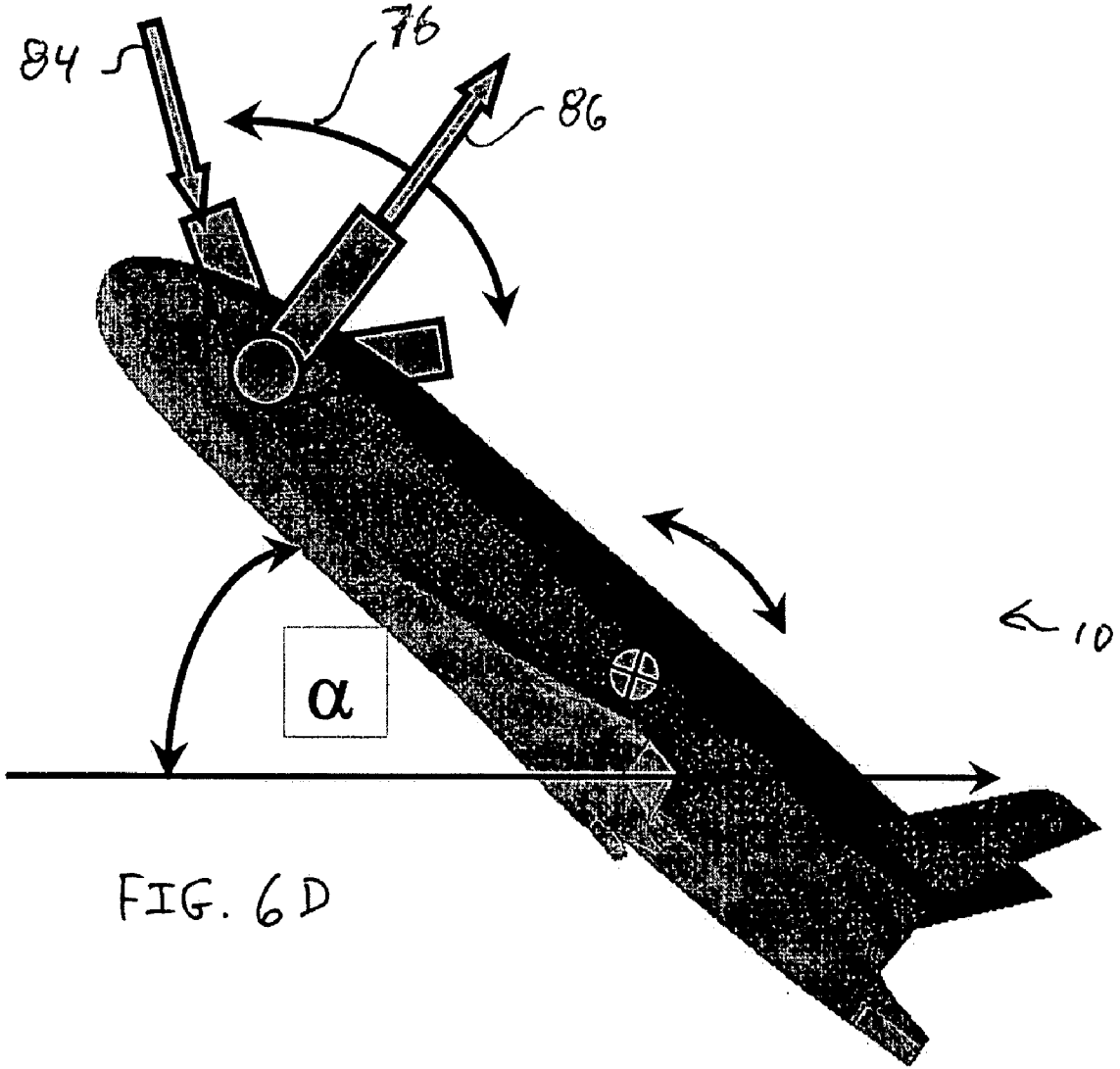

Referring now to FIGS. 6A–H, optional ring canards may be provided, if desired, for additional or independent pitch and yaw control. As shown in FIG. 6A, a canard 76 has variable incidence as indicated by an arrow 78. The canard 76 has substantially no twist applied to it. As shown in FIGS. 6B and 6C, a canard 80 has a countertwist of +/−10° applied to it by rotation of the hull's opposing side-supports (electromechanically driven from within) such that the canard 76 asymmetrically distorts its shape and thereby skews itself to a sideslip angle $\beta=-5°$ relative to the hull 12. A canard 82 has an opposite counter-twist of −/+10' applied to it such that the canard 76 skews to a sideslip angle $\beta=+5°$ relative to the hull 12. In this manner, lateral forces are generated at the forward hull for steering. Referring now to FIG. 6D, any of the canards 76, 80, or 82 provide pitch control about a center of gravity of the glider 10 as indicated by angle of attack α. Incidence toward a forward portion of the arrow 76 results in a download 84. Incidence further along the arrow 76 results in an upload 86.

Referring to FIGS. 6E and 6F, the canard 76 with no applied twist generates zero lateral control forces. Referring to FIG. 6G, the canard 82 generates nose right lateral control forces. Referring to FIG. 6H, the canard 80 generates nose left lateral control forces.

Figure 7:
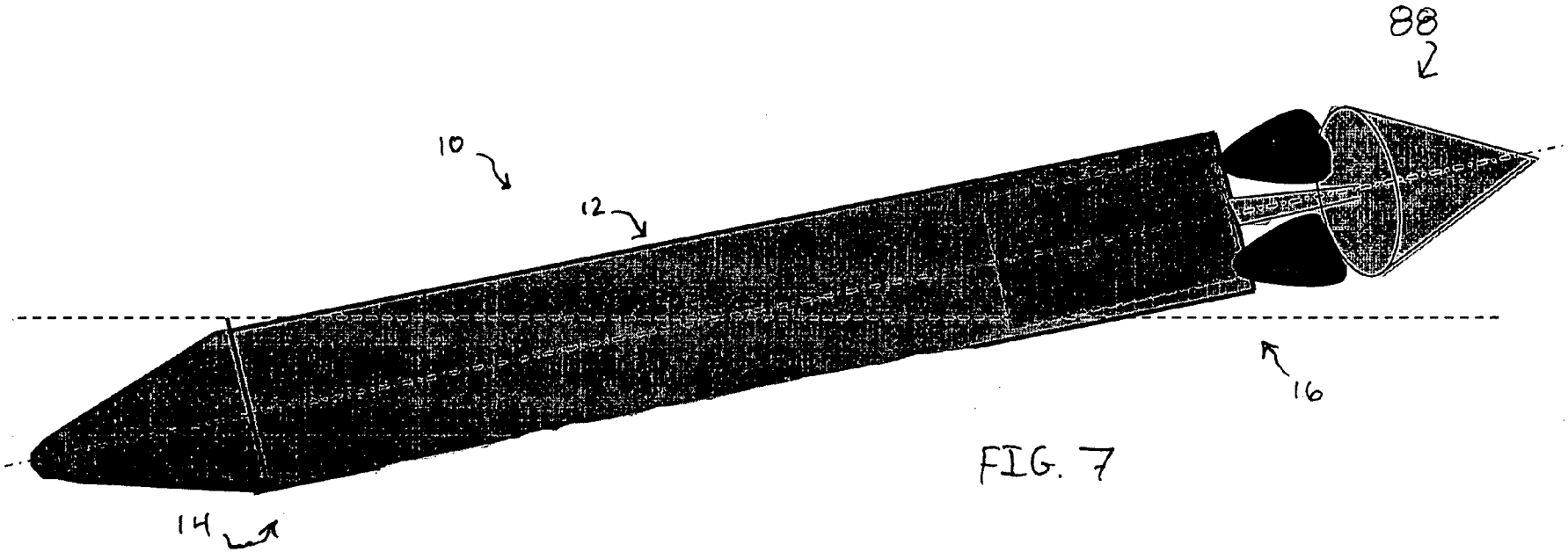
FIG. 7 illustrates details of a tail cone of the glider of FIG. 1.

Referring now to FIG. 7, a conical afterbody section, such as a tail cone 88, is provided toward the stern 16 of the glider 10. Advantageously, the tail cone 88 reduces base drag of the glider 10, thereby aiding gliding efficiency. In one exemplary embodiment, the tail cone 88 is inflatable. The tail cone 88 suitably is stored within the stern 16, and is deployed and inflated during its approach and landing phase. 10. The tailcone 88 is rapidly inflated by a gas, such as an inert gas like nitrogen gas, that is released into it from a pressurized container (not shown) stored within the stern 16. A valve (not shown) preset to open at a selected pressure, altitude or depth, or a time of flight device (not shown) can be used to initiate the pressurized gas flow.

Figure 8:
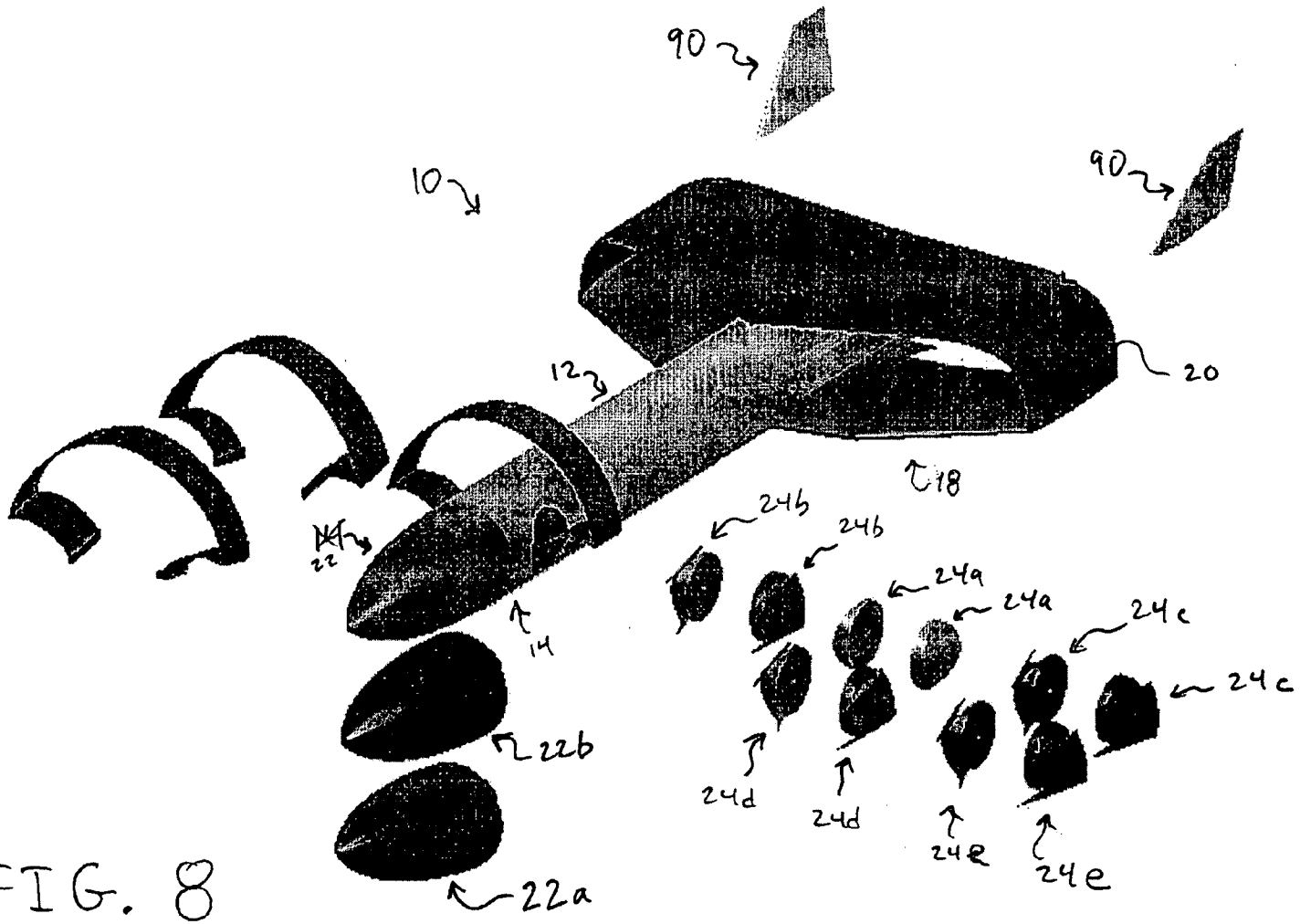
FIG. 8 is an exploded perspective view of alternate components of the glider of FIG. 1.

Referring now to FIG. 8, in one presently preferred embodiment the nose cone 22 is "bent." That is, the nose cone 22 has an axis this is not collinear with an axis of the hull 12. Advantageously and as a result, the nose cone 22 functions as a preset lifting component for achieving self-trim in pitch. In one exemplary embodiment, the nose cone 22 is bent by around 5 degrees or so. In other embodiments, a nose cone 22*a* is bent by around ten degrees or so. However, in other embodiments, a nose cone 22*b* is not bent or has substantially no bend. While some amount of "bend" to the nose cone is desirable and is presently preferred to aid in pitch control, it will be appreciated that any amount of "bend" may be provided as desired, if any bend is provided at all.

Still referring to FIG. 8, several variations may be provided to components of the glider 10. Given by way of nonlimiting example, steering devices 24*a*, 24*b*, and 24*c* suitable have deflections of around zero degrees, ten degrees, and twenty degrees, respectively. Given by way of further nonlimiting examples, steering devices 24*d* and 24*e* have incidences of around minus ten degrees and minus twenty degrees, respectively. However, it will be appreciated that any steering device may have any deflection or incidence as desired for a particular application.

Still referring to FIG. 8, optional vertical stabilizers 90 may be provided as needed for further enhancement of the vehicle's lateral stability. The optional vertical stabilizers 90 are optionally provided in addition to the stabilizers 20. If provided, the optional vertical stabilizers 90 are attached to the outboard regions of the upper wing panel 60.

Figure 9:
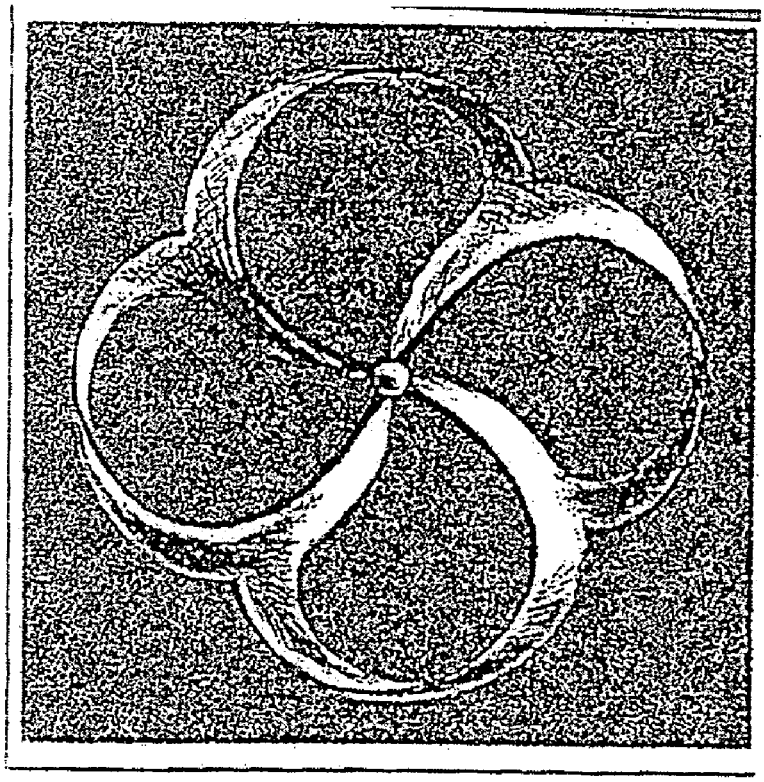
FIG. 9 is an end view of an exemplary propeller of the gliders of FIGS. 1 and 2.

Referring now to FIG. 9, a propeller 92, such as without limitation a ring propeller, may be provided if desired for higher speed operations. Referring additionally to FIGS. 1 and 2, the propeller 92 may be included with the glider 10 as part of a propulsion system (not shown), such as jet skis. The propeller 92 may be included with the glider 30 as part of the jet skis 42. Advantageously, the jet skis 42 and the propeller 92 provide the gliders 10 and 30 with emergency propulsion power that enables the gliders 10 and 30 to clear datum and egress from serious threats or from situations in which tactical advantage has been lost. Ring propellers are well known in the art. As a result, details of their construction and operation are not necessary for an understanding of the present invention.

Figure 10:
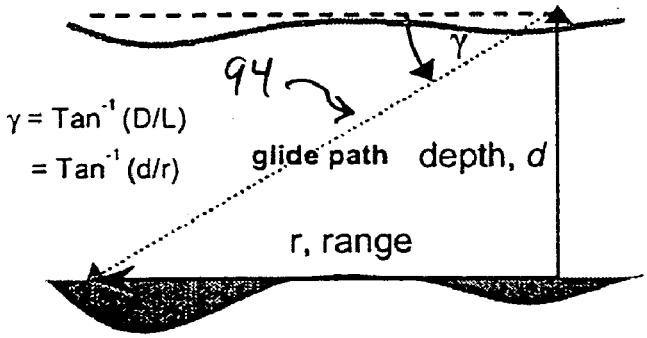
FIG. 10 is a graph of step-wise glider range for the glider of FIG. 1.

Referring now to FIG. 10, step-wise glider range of the glider 10 is graph as a function of depth d versus range r. As is known, the ratio of range r to depth r equals lift-to-drag ratio. That is, $$r/d=L/D \tag{1}$$

As is also known, $$\gamma=\mathrm{Tan}^{-1}(D/L)=\mathrm{Tan}^{-1}(d/r) \tag{2}$$

Accordingly, application of equations (one) and (two) yields a glide path 94. Referring to Table 1, the range r varies from a range of 500 ft. (at a depth of 100 ft.) for a lift-to-drag ratio of 5 to a range or of 800 ft. (at a depth of 100 ft.) for a lift-to-drag ratio of 8.

TABLE 1

| L/D (max) | γ (deg) | r/d | glider range r (ft.) (@d = 100 ft.) |
|---|---|---|---|
| 5 | 11.3 | 5 | 500 |
| 6 | 9.5 | 6 | 600 |
| 7 | 8.1 | 7 | 700 |
| 8 | 7.1 | 8 | 800 |

Referring now to FIGS. 11–15, test data was taken in a low speed wind tunnel (Mach number of 0.15) using a model of the glider 10 with upper and lower wing panels 60 and 62 swept at 35° and 45°. For comparison purposes, data was also taken of models of glider with conventional wing panels swept at 35° and 45° and an aft centerline vertical and trailing rudder (instead of the arch wing design of the lifting surface 18 and the conformal steering devices 24).

Figure 11:
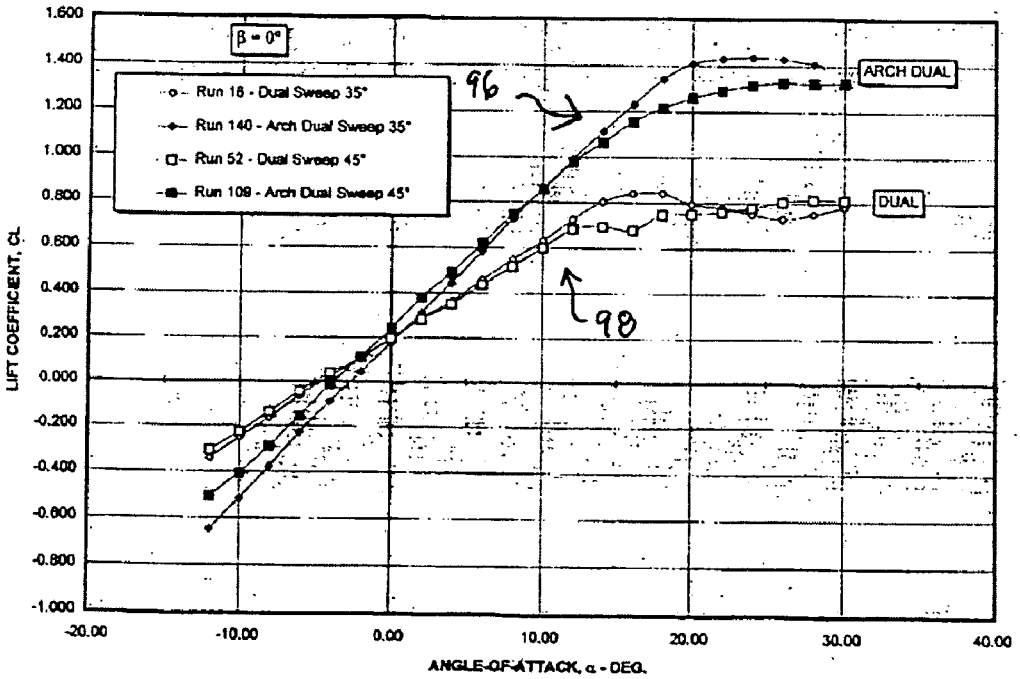
FIG. 11 is a graph of lift coefficient versus angle of attack for the glider of FIG. 1.
Figure 16:
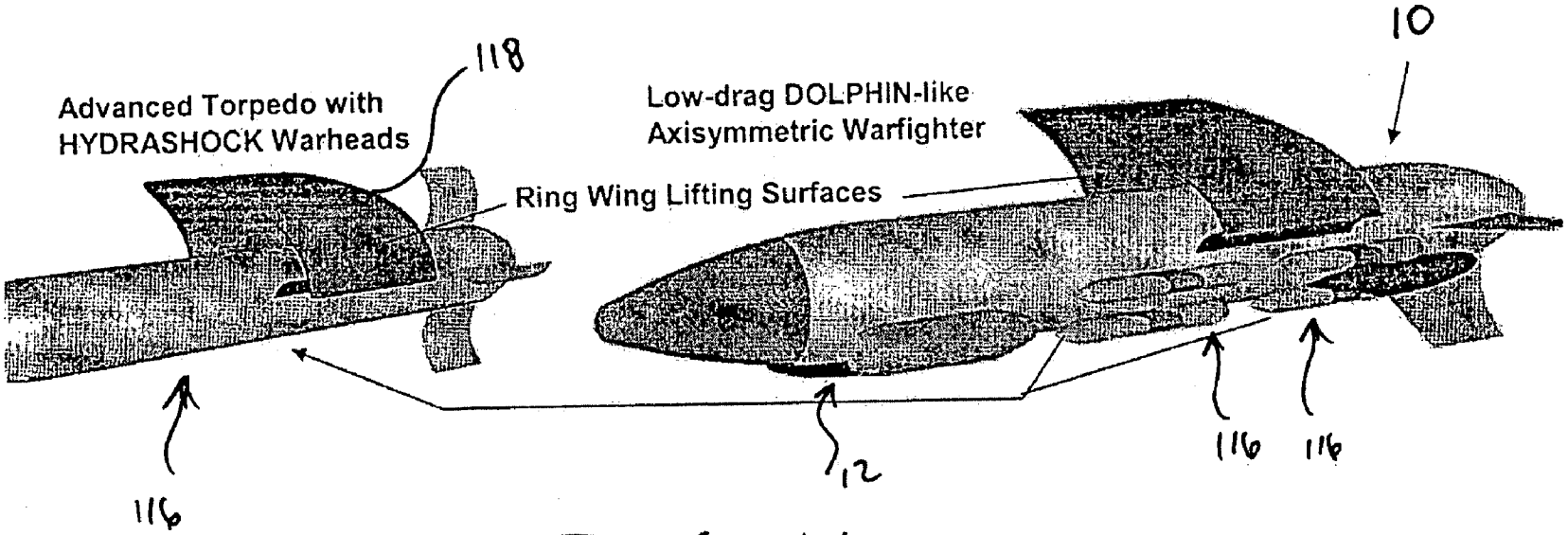
FIG. 16 is a perspective view of the glider of FIG. 1 outfitted with external stores.

FIG. 11 illustrates lift enhancement of the glider 10. Lift coefficient $C_L$ was graphed versus angle of attack α. A 50% increase was measured in slope of lift curves 96 for the glider 10 over lift curves 98 four the conventional gliders. In addition, a gentle stall was noted to occur above 20° angle of attack.

FIG. 12 illustrates increased glider range of the glider 10. Lift-to-drag ratio L/D was graphed versus angle of attack α. Curves 100 taken for the glider 10 show a 20% higher maximum lift-to-drag ratio ($L/D_{max}$) then a maximum lift-to-drag ratio($L/D_{max}$) of curves 102 four the conventional gliders. Advantageously and as a result, this 20% increase in maximum lift-to-drag ratio ($L/D_{max}$) results in a 20% increase in glide range enjoyed by the glider 10 over conventional gliders (see Equations (1) and (2)).

FIG. 11 illustrates higher stability in pitch. Lift coefficient $C_L$ was graphed versus pitching moment coefficient $C_m$. Curves 104 for the glider 10 show increased lift acting aft of center of gravity of the glider 10 than curves 106 show for conventional gliders. Advantageously and as a result, this imparts in increased stability in pitch to the glider 10.

FIG. 14 illustrates higher stability in sideslip. Yawing moment $C_n$ was graphed versus angle of sideslip β. Curves 108 for the glider 10 show a higher stability in sideslip over curves 110 for conventional gliders due to the stabilizer surfaces 20 acting as twin, outboard vertical stabilizers.

FIG. 15 illustrates effectiveness of the conformal steering devices 24 in generating yawing moments. Incremental yawing moment coefficient per deflection δ was graphed versus angle of sideslip β four and angle of attack α of 16°. Curves 112 for the glider 10 and curves 114 for conventional gliders highlight increased effectiveness of the steering devices 24 in generating yawing moments due to their deflection increases with increasing angles of attack. Test data taken at high angle of attack and with 20° deflection of the left-hand side panel on the forebody exhibits significant yawing moment control over a sideslip range of +/−10°.

Referring now to FIGS. 16 and 17A–C, the glider???? 10 has been outfitted to carry external stores 116, such as torpedoes. Preferably, the torpedoes 116 are lightweight and compact torpedoes with advanced warheads. Given by way of nonlimiting example, in one presently preferred embodiment, the torpedoes 116 may include a ring wing 118 and advanced warheads, such as HYDRASHOCK warheads. Details regarding the ring wing 118 are set forth in "Ring Wing for an Underwater Missile," AIAA 1993-3651, by H. August and E. Carapezza, the contents of which are hereby incorporated by reference. Details regarding the HYDRASHOCK warhead are set forth in U.S. Pat. No. 5,078,069 entitled "Warhead", issued Jan. 7, 1992, the contents of which are hereby incorporated by reference. Further, the glider 10 may be outfitted with electronic systems, such as a sonar system and a fire control system (not shown), that are housed within the hull 12.

Figures 17A, 17B:
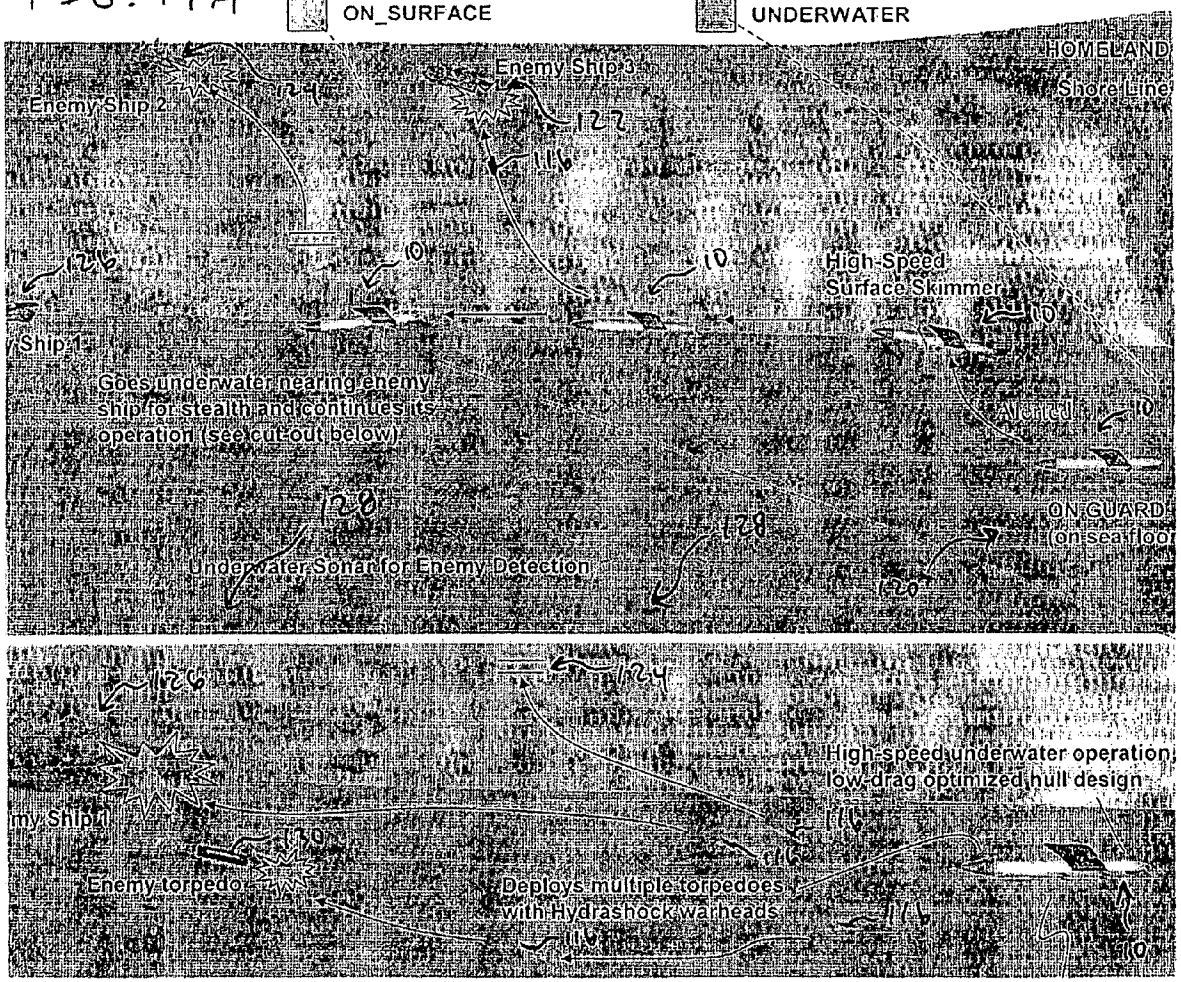
FIG. 17A illustrates a scenario of an exemplary mission performed by the glider of FIG. 16.
FIG. 17B illustrates details of a portion of the mission of FIG. 17A.

As shown in FIGS. 17A and 17B, the glider 10 outfitted with the torpedoes 116, sonar, and fire control systems, advantageously is suited for performing missions such as homeland defense scenarios. In FIG. 17A, the glider 10 patrols submerged on guard at a station 120 by gliding along its glide path and buoying toward the sea surface. When the glider 10 is alerted by underwater sonar 128 to presence of enemy ships 122, 124, and 126, the glider 10 buoys to the surface and closes range to engage the enemy ship 122. The glider 10 engages the enemy ship 122 with a torpedo 116. In FIG. 17B, the glider 10 has submerged to engage the enemy ships 124 and 126 with torpedoes 116. The glider 10 increases its stealth and maintains tactical advantage over the enemy ships 124 and 126 by gliding along its glide range. The glider 10 engages the enemy ships 124 and 126 with torpedoes 116. If the enemy ship 126 attempts to engage the glider 10 with a torpedo 130, then the glider 10 engages the torpedo 130 with a torpedo 116.

Figure 17C:
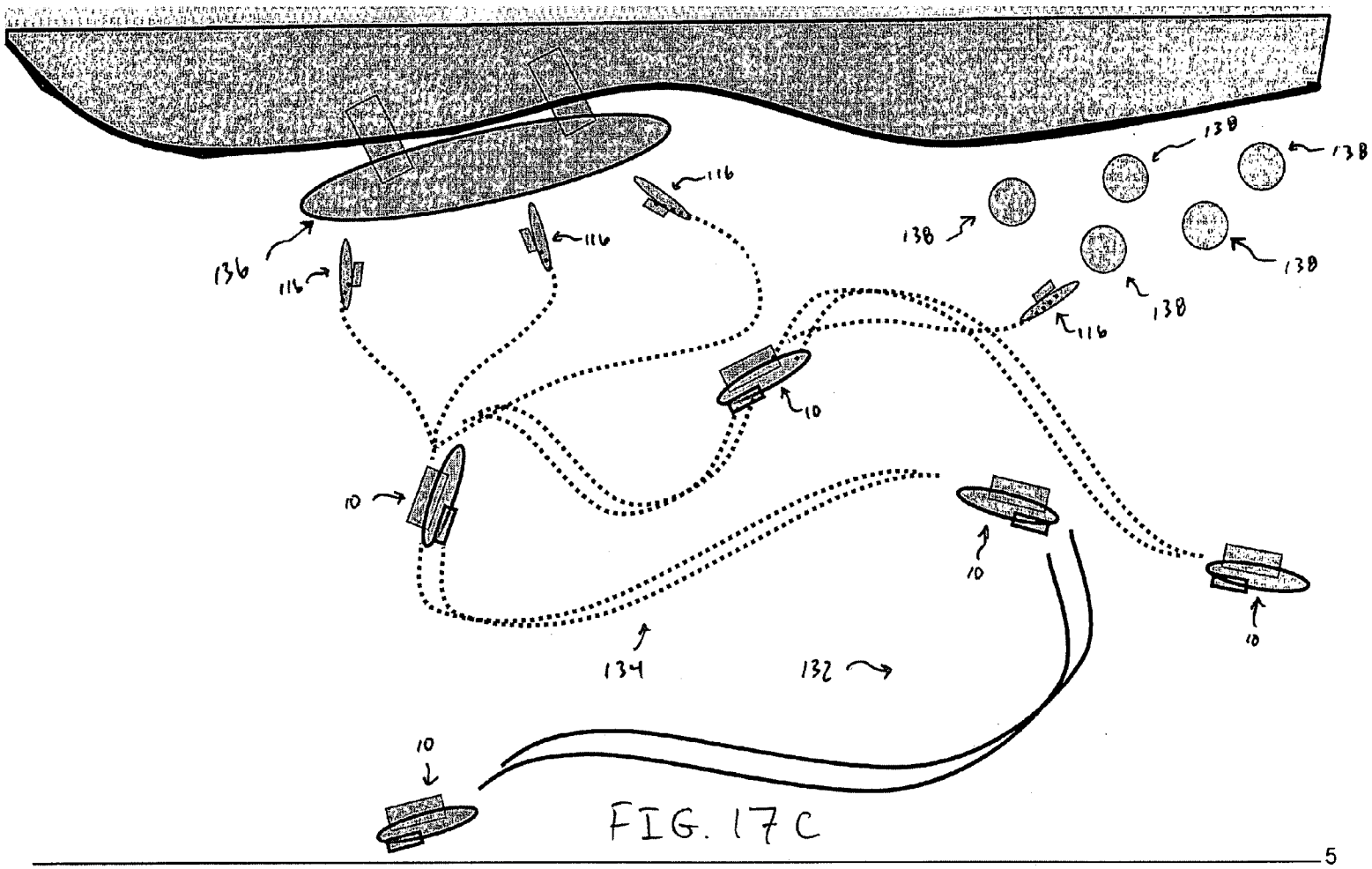
FIG. 17C illustrates a scenario of another exemplary mission performed by the glider of FIG. 16.

In addition to being well-suited for blue water, open ocean operations, the glider 10 is also well-suited for littoral warfare operations. In FIG. 17C, the glider 10 operates in an offshore submerged patrol area 132. The glider 10 submerges in a littoral operation area 134 and engages an enemy ship 136 with torpedoes 116. In addition, the glider 10 engages a plurality of mines 138 with torpedoes 116.

Figures 18A, 18B:
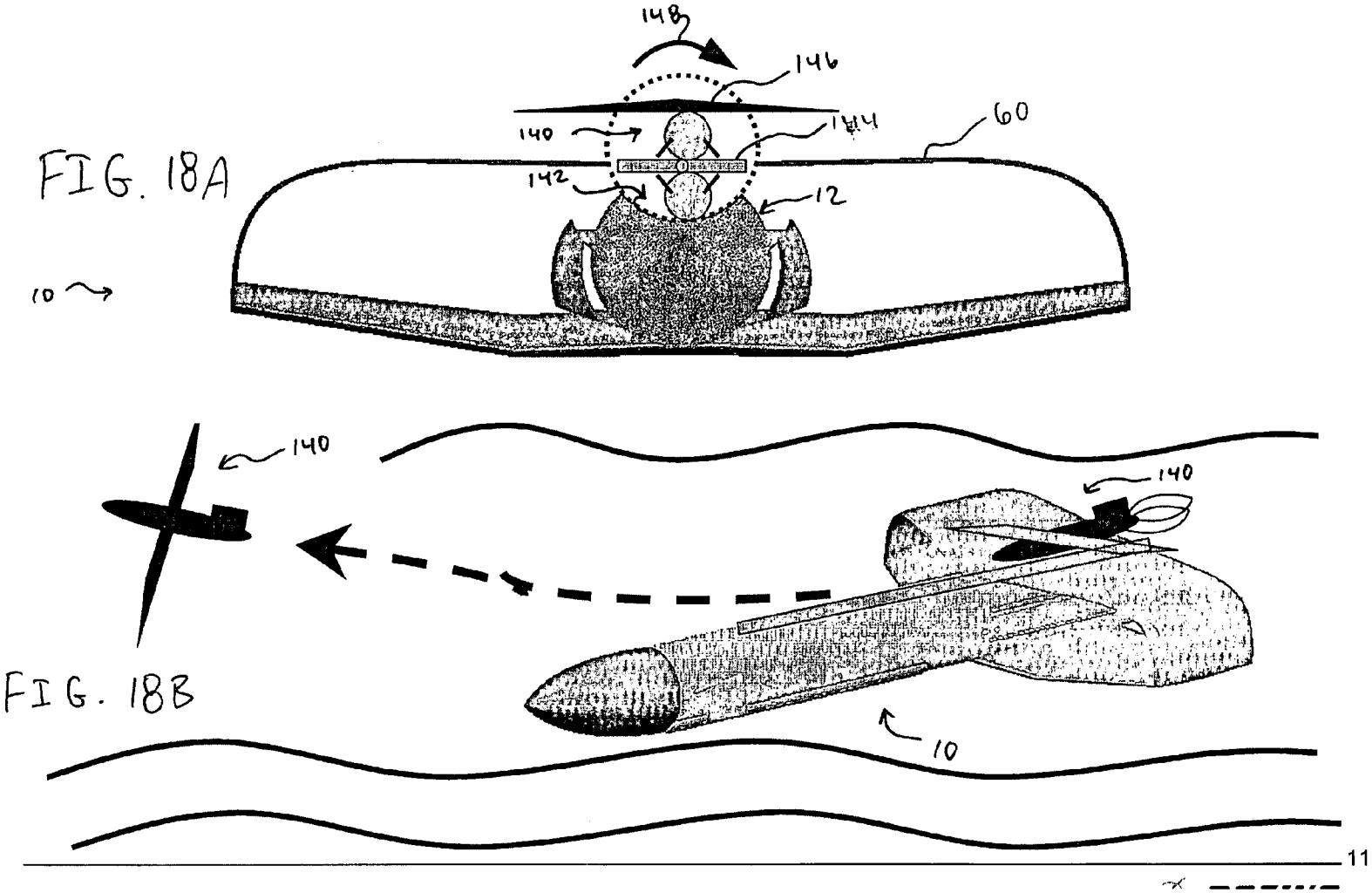
FIGS. 18A and 18B illustrate transport and launch of an unmanned aerial vehicle from the glider of FIG. 1.

Referring now to FIGS. 18A and 18B, the glider 10 advantageously is well-suited for carrying an internal store, such as an unmanned aerial vehicle (UAV) 140, in a hold 142 that is defined within the hull 12. The UAV 140 is releasably mounted to an underside of a hatch 144 that is part of the upper wing panel 60. Wings 146 of the UAV 140 are stored longitudinally aligned with an axis of the UAV 140 and the glider 10. The hatch 144 is rotated as indicated by an arrow 148, thereby positioning the UAV 140 outside of the hull 12 and aligned along its outside of the hull 12 for takeoff. The wings 146 are rotated in position for flight, and the UAV 140 takes off from the glider 10.

Figure 19:
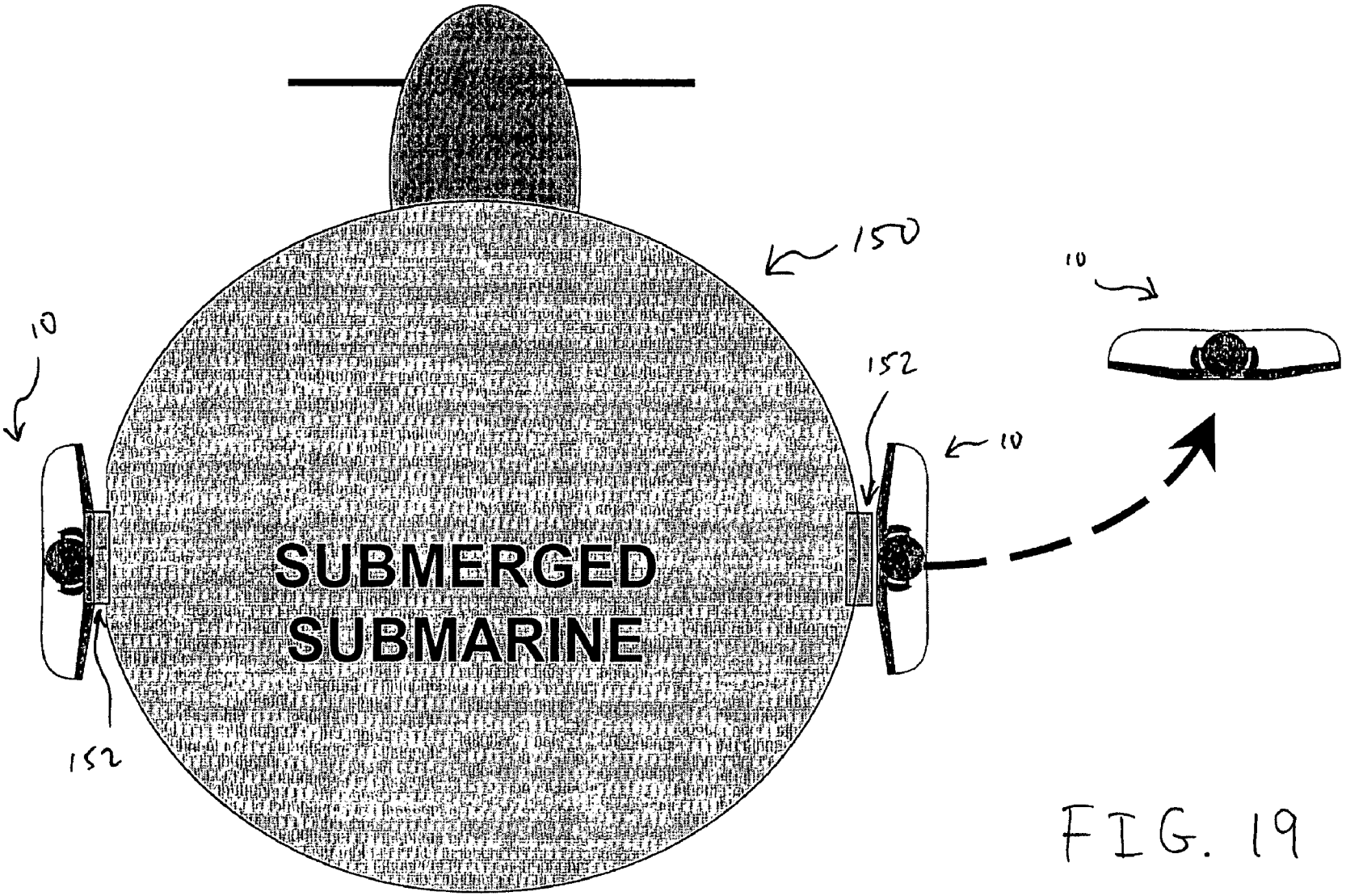
FIG. 19 illustrates transport and launch of the glider of FIG. 1 from a submerged submarine.

Referring now to FIG. 19, the glider 10 suitably is transported to operation areas (not shown) by a submerged submarine 150. The glider 10 is attached to an exterior of the submarine 150 with a suitable carriage 152. The carriage 152 releasably attaches the glider 10 to the submarine 150. The releasable attachment may be accomplished by any acceptable attachment method. For example, the carriage 152 may include mechanical latches, hooks, or the like to releasably attach the glider 10 to the submarine 150 and launch the glider 10 for operations. Alternately, the carriage 152 may use magnets, electromagnets, air bags, or the like to attach and launch the glider 10.

Figures 20A, 20B, 21A, 21B:
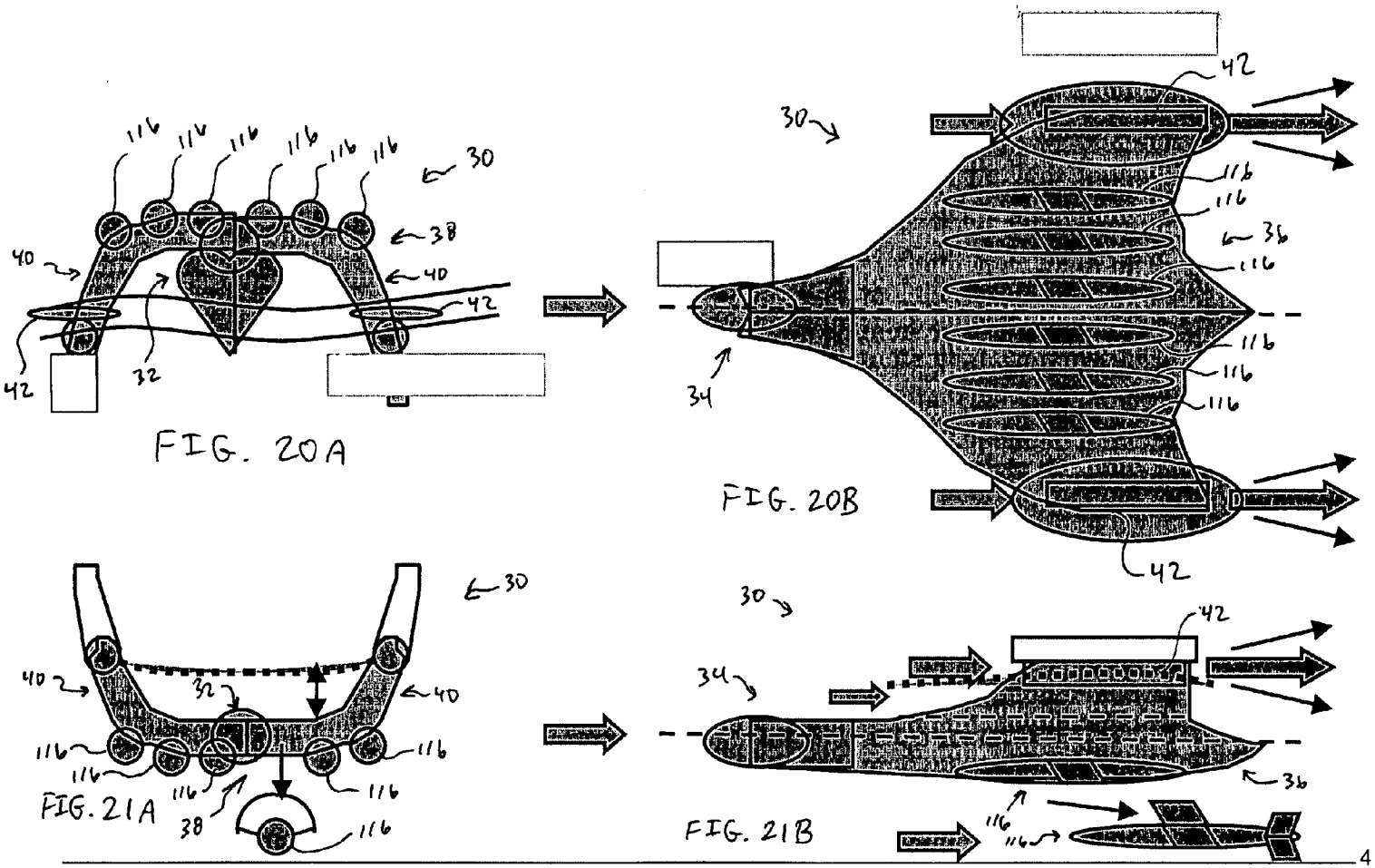
FIGS. 20A and 20B are plan views of the glider of FIG. 2 when surfaced.
FIGS. 21A and 21B are plan views of the glider of FIG. 2 when submerged.

Referring now to FIGS. 20A–B and 21A–B, it will be appreciated that the glider 30 is also well-suited for blue water, open ocean missions as well as close-in, littoral missions. Referring first to FIG. 20A, a plurality of the torpedoes 116 may be mounted on the planar surface 38. The glider 30 is surfaced, and the glider 30 is supported on the surface of the water by the wave-piercing hull 32 and the lifting skis 42. As such, the glider 30 when surfaced has a catamaran configuration. That is, the planar surface 38 is spaced above the surface of the water. Referring briefly to FIG. 20B, it will be appreciated that, looking down, in one embodiment the glider 30 has an appearance of a manta ray.

Referring now to FIGS. 21A and 21B, the glider 30 is submerged. Because the glider 30 is submerged, it will be appreciated that the glider 30 has negative buoyancy or neutral buoyancy. In the submerged configuration, the wave-piercing hull 32 is interposed between the surface of the water and the planar surface 38. That is, the glider 30 is inverted compared to the configuration of the glider 30 as shown in FIG. 20A.

It will be appreciated that the glider 30 may also include electronics systems, such as sonar and fire control systems, the torpedoes 116, and the lifting skis 42 including the propellers 92 similar to the glider 10. With inclusion of such features, the glider 30 is similarly suitable for performing the missions described above for the glider 10.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A submersible glider comprising:

an inflatable wave-piercing hull having a bow and a stern; and a first generally planar lifting surface disposed toward the stern, the first lifting surface having a pair of generally planar stabilizer surfaces extending generally perpendicular to a plane of the first lifting surface from ends of the first lifting surface.

2. The glider of claim 1, wherein the hull is substantially cylindrical.

3. The glider of claim 2, further comprising a nose cone disposed at the bow.

4. The glider of claim 3, wherein the nose cone has an axis that is not collinear with an axis of the hull.

5. The glider of claim 2, further comprising a second generally planar lifting surface disposed toward the stern, the second lilting surface being substantially parallel to the first lifting surface and being attached to the pair of stabilizer surfaces.

6. The glider of claim 5, wherein the second lifting surface includes control surfaces.

7. The glider of claim 6, wherein the control surfaces include elevons.

8. The glider of claim 2, further comprising at least one steering device disposed toward the bow.

9. The glider of claim 8, wherein the steering device includes a deflection surface that is spaced apart from the hull such that a boundary layer of fluid is flowable between the deflection surface and the hull.

10. The glider of claim 2, further comprising a canard disposed toward the bow.

11. The glider of claim 10, wherein the canard includes a ring canard that is collapsible against the hull.

12. The glider of claim 2, further comprising a tail cone section disposed at the stern.

13. The glider of claim 12, wherein the tail cone is inflatable.

14. The glider of claim 1, further comprising a propulsion system.

15. The glider of claim 14, wherein the propulsion system includes a jet ski.

16. The glider of claim 15, wherein the propulsion system further includes a ring propeller.

17. The glider of claim 15, further comprising a lifting ski disposed toward the bow.

18. The glider of claim 1, further comprising at least one attachment device configured to releasably attach at least one external store.

19. The glider of claim 18, wherein the at least one external store includes a torpedo.

20. The glider of claim 1, wherein the hull defines a hold, the glider further comprising a hatch configured to releasably seal the hold.

21. The glider of claim 20, wherein the hold includes a personnel cabin.

22. The glider of claim 20, wherein the hold is configured to receive an internal store.

23. The glider of claim 22, wherein the internal store includes an unmanned aerial vehicle (UAV).

24. The glider of claim 22, wherein the internal store includes an unmanned aerial vehicle (UAV).

25. A submersible glider having a step-wise glider range, the glider comprising:

a substantially cylindrical hull having a bow and a stern;

a first generally planar lifting surface disposed toward the stern, the first lifting surface having a pair of generally planar stabilizer surfaces extending generally perpendicular to a plane of the first lifting surface from ends of the first lifting surface;

a nose cone disposed at the bow; and at least one steering device disposed toward the bow, the steering device including a deflection surface that is spaced apart from the hull such that a boundary layer of fluid is flowable between the deflection surface and the hull.

26. The glider of claim 25, further comprising a second generally planar lifting surface disposed toward the stern, the second lifting surface being substantially parallel to the first lifting surface and being attached to the pair of stabilizer surfaces.

27. The glider of claim 26, wherein the second lifting surface includes control surfaces.

28. The glider of claim 27, wherein the control surfaces include elevons.

29. The glider of claim 25, further comprising a canard disposed toward the bow.

30. The glider of claim 29, wherein the canard includes a ring canard that is collapsible against the hull.

31. The glider of claim 25, further comprising a tail cone section disposed at the stern.

32. The glider of claim 31, wherein the tail cone is inflatable.

33. The glider of claim 25, wherein the nose cone has an axis that is not collinear with an axis of the hull.

34. The glider of claim 25, further comprising a propulsion system.

35. The glider of claim 34, wherein the propulsion system includes a jet ski.

36. The glider of claim 35, wherein the propulsion system further includes a ring propeller.

37. The glider of claim 35, further comprising a lifting ski disposed toward the bow.

38. The glider of claim 25, further comprising at least one attachment device configured to releasably attach at least one external store.

39. The glider of claim 38, wherein the at least one external store includes a torpedo.

40. The glider of claim 25, wherein the hull defines a hold, the glider further comprising a hatch configured to releasably seal the hold.

41. The glider of claim 40, wherein the hold includes a personnel cabin.

42. The glider of claim 40, wherein the hold is configured to receive an internal store.

43. A submersible glider comprising:

a wave-piercing hull having a bow and a stern;

a generally planar surface substantially disposed toward the stern, the generally planar surface having a pair of generally planar stabilizer surfaces extending generally perpendicular to a plane of the generally planar surface from ends of the generally planar surface; and a pair of lifting skis disposed on the pair of stabilizer surfaces.

44. The glider of claim 43, wherein the glider has a first state having positive buoyancy.

45. The glider of claim 44, wherein the glider is configured to float on the pair of lifting skis and the wave-piercing hull when the glider is in the first state, such that the generally planar surface is spaced above a surface of water.

46. The glider of claim 43, wherein the glider has a second state having at least one of neutral buoyancy and negative buoyancy.

47. The glider of claim 46, wherein the wave-piercing hull is interposed between the generally planar surface and a surface of water when the glider is in the second state.

48. The glider of claim 43, further comprising a propulsion system.

49. The glider of claim 48, wherein the propulsion system includes a jet ski.

50. The glider of claim 49, wherein the jet ski includes a ring propeller.

51. The glider of claim 43, further comprising at least one attachment device configured to releasably attach at least one external store.

52. The glider of claim 51, wherein the at least one external store includes a torpedo.

53. The glider of claim 43, wherein the hull defines a hold, the glider further comprising a hatch configured to releasably seal the hold.

54. The glider of claim 53, wherein the hold includes a personnel cabin.

55. The glider of claim 43, further comprising a towing mechanism configured to reel in and reel out a towline from the glider.

56. A marine transport system comprising:

a submersible glider having a step-wise glider range; and a surfaced glider having a towing mechanism configured to reel in and reel out from the surfaced glider a towline that is connectable to the submersible glider.

57. The system of claim 56, wherein the surfaced glider defines a hold, the surfaced glider further comprising a hatch configured to releasably seal the hold.

58. The system of claim 57, wherein the hold includes a personnel cabin.

59. The system of claim 56, wherein the submersible glider includes:

a substantially cylindrical hull having a bow and a stern;

a first generally planar lifting surface disposed toward the stern, the first lifting surface having a pair of generally planar stabilizer surfaces extending generally perpendicular to a plane of the first lifting surface from ends of the first lifting surface;

a nose cone disposed at the bow; and at least one steering device disposed toward the bow.

60. The system of claim 56, wherein the surfaced glider includes:

a wave-piercing hull having a bow and a stern;

a generally planar surface substantially disposed toward the stern, the generally planar surface having a pair of generally planar stabilizer surfaces extending generally perpendicular to a plane of the generally planar surface from ends of the generally planar surface; and a pair of lifting skis disposed on the pair of stabilizer surfaces.

* * * * *